US012584405B2

(12) United States Patent
Toniolo et al.

(10) Patent No.: US 12,584,405 B2
(45) Date of Patent: Mar. 24, 2026

(54) COMMUNICATION METHOD FOR UNTETHERED DOWNHOLE SYSTEMS

(71) Applicant: Schlumberger Technology Corporation, Sugar Land, TX (US)

(72) Inventors: Julien Toniolo, Sugar Land, TX (US); Henry Nguyen, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/660,340

(22) Filed: May 10, 2024

(65) Prior Publication Data

US 2025/0347222 A1 Nov. 13, 2025

(51) Int. Cl.
*E21B 47/18* (2012.01)

(52) U.S. Cl.
CPC ..... *E21B 47/18* (2013.01)

(58) Field of Classification Search
CPC ..... E21B 47/12; E21B 47/14; E21B 47/18; E21B 47/20; E21B 47/22; E21B 47/24
See application file for complete search history.

(56) References Cited

U.S. PATENT DOCUMENTS

| | | | | |
|---|---|---|---|---|
| 10,316,652 | B2 * | 6/2019 | Lee | E21B 47/24 |
| 10,533,413 | B2 * | 1/2020 | Logan | E21B 47/09 |
| 12,221,881 | B2 * | 2/2025 | Toniolo | E21B 23/01 |

FOREIGN PATENT DOCUMENTS

WO 2021016443 A1 1/2021

* cited by examiner

*Primary Examiner* — Franklin D Balseca
(74) *Attorney, Agent, or Firm* — Jeffrey D. Frantz

(57) ABSTRACT

The disclosure provides methods of communication for untethered systems. The method includes defining a window for sampling a torque-related current and a modulator rotor relative position-related parameter; using the defined window, recording local maximum and local minimum values of the torque-related current versus a modulator rotor relative position-related parameter of a rotor of a rotary pulser system in the untethered system; identifying at least one of consecutive torque-related current minimum values and consecutive torque-related current maximum values based on a periodicity; computing an absolute modulator rotor position based on the periodic maxima and minima of the torque-related current; and controlling the modulator rotor using the absolute modulator rotor position to modulate uplink signals to a surface environment.

5 Claims, 7 Drawing Sheets

COMMUNICATION METHOD FOR UNTETHERED DOWNHOLE SYSTEMS

CROSS-REFERENCE TO RELATED APPLICATIONS

None.

FIELD OF THE DISCLOSURE

Aspects of the disclosure relate to communication methods for downhole equipment used in oil and gas recovery. More specifically, aspects of the disclosure relate to communication methods for untethered downhole systems. Untethered downhole systems may be systems that are being transferred from an up-hole location to a downhole location. Such transfers are commonly performed through using a drilling mud to push the untethered downhole system to a final desired location.

BACKGROUND

Accurate downhole measurements are necessary in modern hydrocarbon recovery operations. These downhole measurements allow operators the ability to diagnose the status of a project from inception to completion. While there are many ways to establish downhole communications, such as conventional mud pulse telemetry systems, there are areas of improvement that should be explored to limit unnecessary economic costs for producing hydrocarbons.

In the field of downhole measurement operations there is a need for communication from the subsurface to the surface. This is commonly defined as an "uplink" where a downhole communication system sends data from a downhole location to an up-hole location. Communications from the surface to a downhole system are commonly referred to as a "downlink". The data, which is obtained by various sensors located in the downhole environment, is transferred to a downhole communication system. After reaching the downhole communication system, the downhole communication system transmits the data through either a wire, in the case of wired drill pipe, or through mud pulses from the downhole environment to an up-hole receiving system. The up-hole receiving system may be equipped with pressure sensors to identify mud pulses when they are received at an up-hole location.

In mud pulse telemetry, the fluid used in cooling and lubricating the drill bit may be channeled through a system that includes a modulator. The modulator is designed to open and close at specific intervals, thereby creating a pressure variation of the fluid. Pressure sensors in the return duct, or channel for the mud, may receive these pulsations and decode the data sent from the downhole location. In such up-link scenarios, the modulator pulses the drilling mud and the received signals, generally sent in bits of information, may be decoded to determine the contents of the data that was transmitted. The data may be sent to the up-hole location. In non-limiting embodiments, the data may relate to downhole temperatures, downhole pressures, or other parameters. In embodiments, the modulator may use a rotor or orifice that opens and closes, thereby varying the pressure in the up-hole drilling fluid.

In embodiments, the mud pulse telemetries are usually modulating the mud pressure using frequency shift keying schemes. In these embodiments a stator is obstructed by a rotor as mud traverses both of the components during normal drilling circulation activities. In these embodiments, the rotor is usually attached to the output shaft of a gearbox. The gearbox is configured with an input shaft, attached to an electric motor, attached to an angle resolver. The use of the angle resolver allows operators to understand the positioning of the input shaft during operations. While the use of this conventional equipment is beneficial, there are instances where such conventional mud pulse technologies cannot be used.

In some instances, due to the short duration of the operations, conventional mud pulse technologies cannot be used. In other instances, up-hole sensors cannot be positioned in correct alignment for signal reception due to obstruction from other equipment. In instances where up-hole sensors may be compromised, other systems may be used as an alternative. For example, a standpipe pressure sensor may be integrated into the drilling rig and be used for reception of pressure signals when up-link signals are slow. The standpipe pressure sensor may be connected to an electronic drilling recorder of the rig.

While the use of a standpipe pressure sensor does provide an alternative, several drawbacks are present with this configuration. The standpipe pressure sensor generally has a slow sampling rate. This sampling rate is typically one sample per second. Another drawback is that the standpipe pressure sensor has generally poor accuracy for these types of measurements. As a result of the above, any signal modulation will need to be slow and have a strong signal to noise ratio in order to effectively use the standpipe pressure sensor.

There is a need to provide an apparatus and methods that are easier to operate than conventional apparatus and methods and allow for communication of untethered downhole systems so that operators may understand the information from the downhole equipment.

There is a further need to provide apparatus and methods that do not have the drawbacks discussed above, namely unknown positioning of equipment being sent to a downhole location.

There is a still further need to reduce economic costs associated with operations and apparatus described above with conventional tools to allow competitive hydrocarbon recovery operations.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are; therefore, not to be considered limiting of its scope, for the disclosure may admit to other equally effective embodiments without specific recitation. Accordingly, the following summary provides just a few aspects of the description and should not be used to limit the described embodiments to a single concept.

In one example embodiment, the method may comprise defining a window for sampling a torque-related current and a modulator rotor relative position-related parameter. The method may also comprise using the defined window, recording local maximum and local minimum values of the torque-related current versus a modulator rotor relative position-related parameter of a rotor of a rotary pulser system in the untethered system. The method may also comprise identifying at least one of consecutive torque-related current minimum values and consecutive torque-related current maximum values based on a periodicity. The method may also comprise computing an absolute modulator rotor position based on the periodic maxima and minima of the torque-related current. The method may also comprise controlling the modulator rotor using the absolute modulator rotor position to modulate uplink signals to a surface environment.

In another example embodiment of the disclosure, a method of communication for a downhole system is described. The method may entail obtaining a downhole system that has a motor, a gearbox, a modulator rotor, and a relative position measurement system. The method may further comprise recording values of a torque-related current versus a position-related parameter during a cycling of the modulator rotor. The method may further comprise placing the downhole system in a tubular within a drilling system. The method may further comprise releasing the downhole system into the tubular. The method may further comprise transporting the downhole system along the tubular through pumping of drilling mud. The method may further comprise during the transporting of the downhole system, sending data from the downhole system as the modulator rotor spins. The method may further comprise receiving the data from the downhole system at an up-hole location. The method may further comprise analyzing the data to extract at least one of a status and message from the downhole system.

In another example embodiment of the disclosure, a method of communication for a downhole system is disclosed. The method may comprise obtaining a downhole system that has a motor, a gearbox, a modulator rotor, and a relative position measurement system. The method may further comprise recording values of a torque-related current versus a position-related parameter during a cycling of the modulator rotor. The method may further comprise placing the downhole system in a tubular within a drilling system. The method may further comprise releasing the downhole system into the tubular. The method may further comprise transporting the downhole system along the tubular through pumping of drilling mud. The method may further comprise during the transporting of the downhole system, sending data from the downhole system as the modulator rotor spins. The method may further comprise receiving the data from the downhole system at an up-hole location. The method may further comprise analyzing the data to extract at least one of a status and message from the downhole system, wherein a modulator rotor is controlled during the transporting of the downhole system to enable an unjamming of the downhole system from a jamming event created by debris accumulation in the modulator.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted; however, that the appended drawings illustrate only typical embodiments of this disclosure and are; therefore, not be considered limiting of its scope, for the disclosure may admit to other equally effective embodiments.

Figure 1:
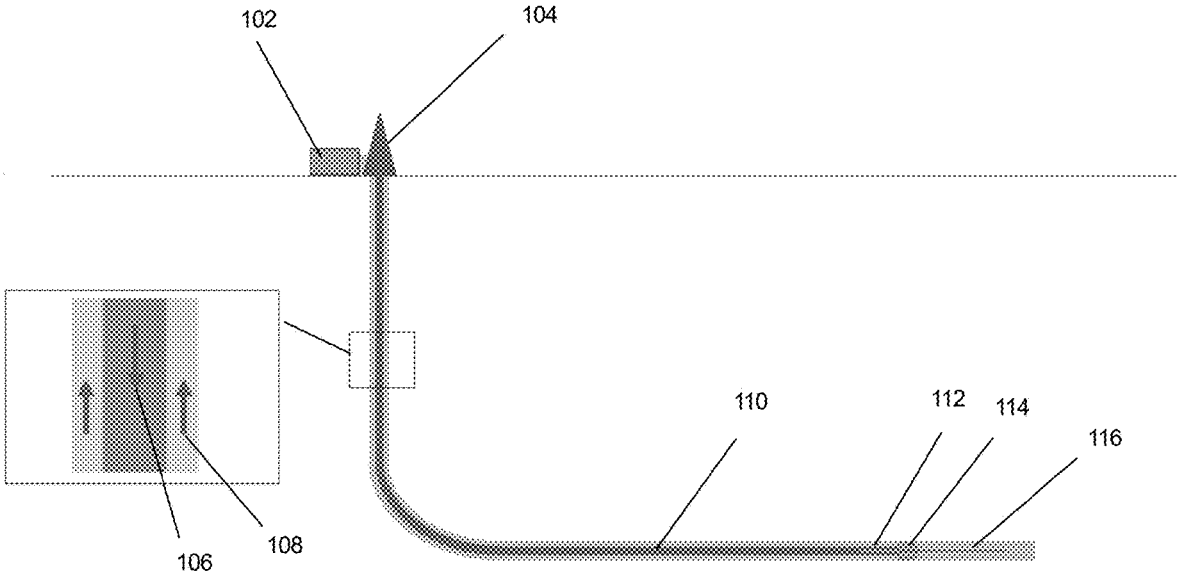
FIG. 1 is a typical configuration for uplink mud pulser communication.
Figure 2:
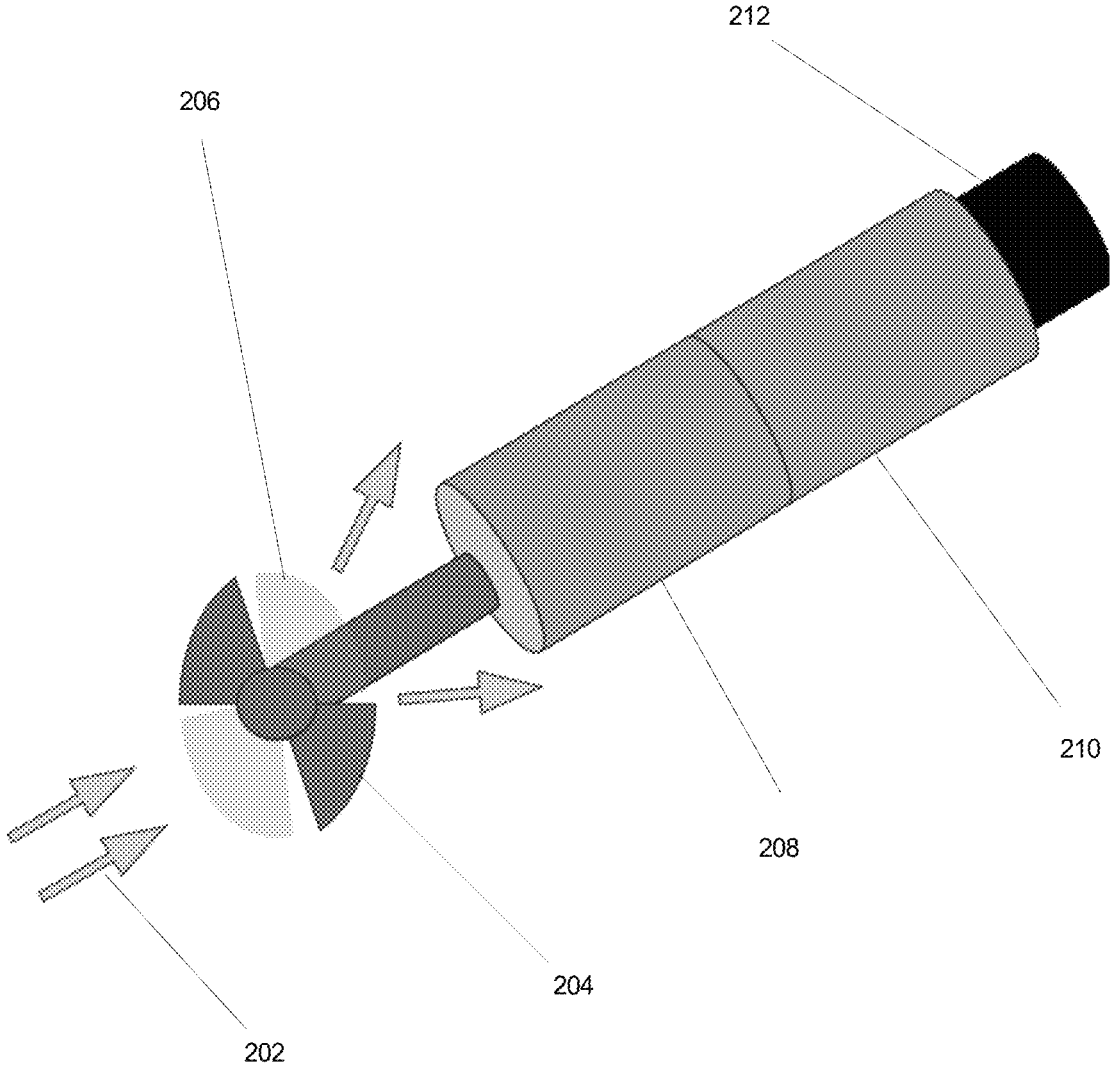
FIG. 2 is a typical configuration of a downhole mud pulser.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood; however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments, and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer, or section. Terms such as "first", "second", and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

When an element or layer is referred to as being "on", "engaged to", "connected to", or "coupled to" another element or layer, it may be directly on, engaged, connected, or coupled to the other element or layer, or interleaving elements or layers may be present. In contrast, when an element is referred to as being "directly on", "directly engaged to", "directly connected to", or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood; however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure provide for determining the absolute position of the rotor of a rotary mud modulator. A rotary mud modulator is made of a rotor, that rotates and a stator that is steady. When the rotor rotates, this action closes and opens a mud pathway through which the mud from the rig pumps circulates. By changing the size of the obstruction, a varying pressure drop is created, that is propagated up-hole and ultimately measured.

The typical rotary modulator functions in a manner where it does not need to know its absolute position, but just its speed. It only knows the speed of opening and closing through the rotational speed of its motor. As such, the position is only relatively known, because after a certain, calculable number of turns of motor, the rotor is determined to come back to its initial position, but the initial position is not known. The downhole system does not know whether this initial position was closed or open, or partially closed.

Further aspects of the disclosure provide for establishing a communication method for untethered downhole systems. The type of untethered downhole systems may include various pieces of technology. In embodiments, a motor, a motor controller, and rotor are provided in the untethered downhole systems in order to allow for communication between the untethered downhole system and the up-hole environment. Such equipment may be used in combination with other equipment to perform functions downhole. Such equipment may be, for example, sampling equipment, acoustic equipment, nuclear equipment, or other specialized equipment, such as fishing equipment.

At times, during hydrocarbon recovery operations, there is a need to send specialized equipment to a downhole location. This equipment may be needed due to an unplanned event, for example. The data from the downhole environment must also be transmitted back to the up-hole environment in an accurate fashion to inform operators of the current status of the project. These specialized categories of downhole measurement systems (electrical, nuclear, pressure sampling) are conveyed in the drill pipe or in the casing. The conveyance may be with or without a tether (mechanical connection). To move the specialized equipment from the up-hole environment to the downhole environment, the equipment is pushed along the drill pipe or casing through use of circulating drilling fluid. The frictional drag of the drilling fluid on the specialized equipment pushes the equipment to the downhole location. The equipment can be seated in the tubular (drill pipe or casing) or be seated such that they extend past the end of the tubular and contact the subterranean formation, also known as an open hole configuration. In embodiments, during pump down, using position control, the motor in the specialized equipment rotates a rotor at desired and steady rotations speeds. The different rotational speeds create different modulator opening and closing frequencies thereby modulating the mud flow pressure.

A standpipe pressure sensor at the surface reads the different open/close patterns from the downhole measurement system during the pump down. A computer connected to the sensor system may be equipped with real-time software that can interpret the signals and provide the feedback to the operator. The operator can be on site or remotely operating the equipment.

In embodiments, the predefined different open/close frequencies can be used to communicate to the surface that the downhole measurement system is efficiently being pumped down. The data provided by the specialized equipment may also indicate the presence of a blockage or other anomaly. In some embodiments, the data may indicate that the specialized equipment is not moving within the drill pipe and that remedial measures are needed to further move the specialized equipment. This may include increasing the overall flow rate of the drilling mud, thereby providing additional force on the specialized equipment. The predefined different open/close frequencies can also be used to communicate to the surface that the downhole measurement system is functioning properly.

Referring to FIG. 1, a typical configuration of an uplink mud pulse communication system is illustrated. The system may be configured around a drilling rig 104 that has been used to create a borehole through rotation of a drill bit 114. The rotation created by the drilling rig 104 is transmitted to the drill bit 114 through a drill string 110. A downhole mud pulser 112 is located prior to the drill bit 114 to create pressure variations in the drilling fluid (mud). Downhole tools 116 may also be located downhole to provide measurements needed by operators. Drilling mud is sent to the downhole environment through use of a mud pump 102 that sends mud through the drill pipe.

In the expanded view portion of FIG. 1, a cross-section of the wellbore is illustrated where mud flow downward is separate from the mudflow traveling towards the surface. In the illustrated embodiment, mud travels from the mud pump 102 through the drill string 106 and returns up the annulus 108.

An expanded view of the mud pulsing equipment 112 is further disclosed. Mud flow passes in the direction illustrated in 202. Modulator rotor 204 spins according to the mud flow. Different positions are possible including a fully opened position and a fully closed position, as noted by the position in 206. A stator, connected to the rotor connects the rotor 204 to a gear box 208. A motor 210 is also provided to the mud pulsing equipment 112 as well as a resolver 212.

Figure 3:
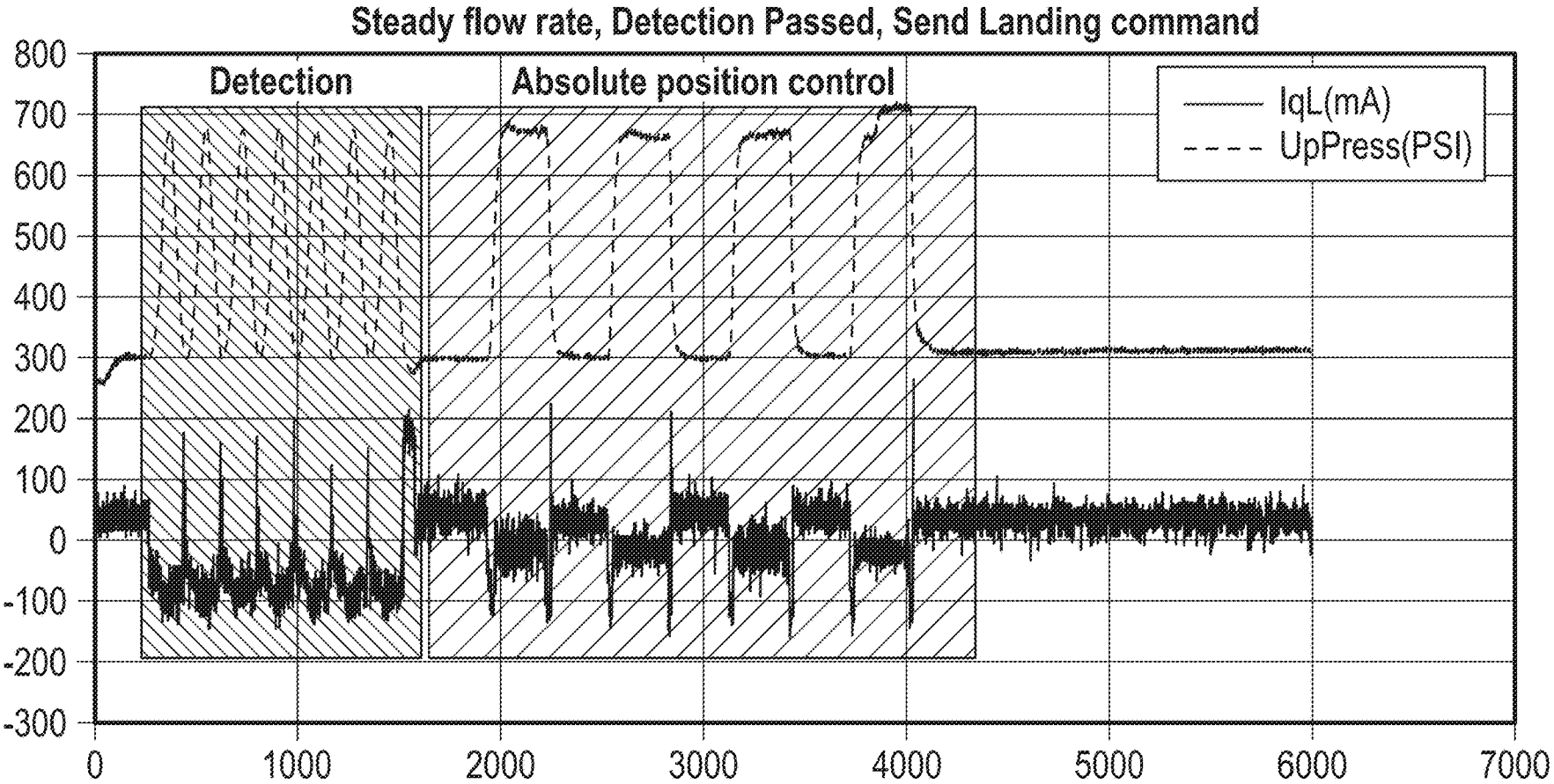
FIG. 3 is a plot of detection sequence performed under steady flow rate.

Referring to FIG. 3, a plot of detection sequence is illustrated. To the left most portion of the figure, a detection sequence is illustrated. The right portion of the figure illustrates absolute position control of the mud pulse equipment. In this figure, a steady state flow is created by the mud pump. In the bottom portion of FIG. 3, a measurement of current over time is provided. The top portion of FIG. 3, illustrates pressure measurements. In the detection sequence, a more sinusoidal graph for pressure is seen. At the right side of the figure, pressure modulation is performed to send pressure pulses to the up-hole detection equipment.

Figure 4:
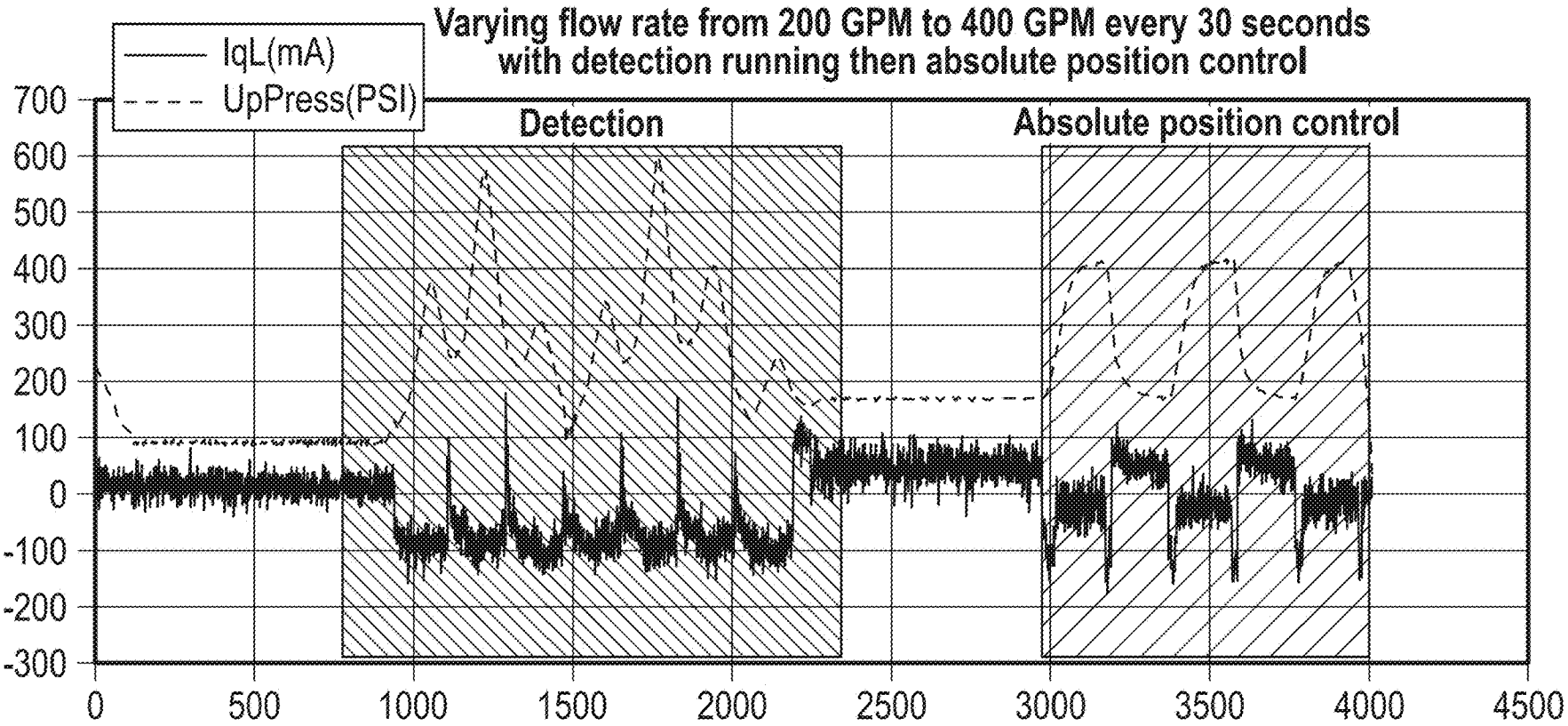
FIG. 4 is a plot of detection sequence performed under varying flow rate.

Referring to FIG. 4, a plot of detection sequence performed under varying flow rate is illustrated. Similar to FIG. 3, the left most portions of the figure are conducted under the detection sequence, where the right most portions of the figure are conducted under absolute position control of the mud pulse equipment. The bottom most portion of the figure relates to measured current where the top-most portion of the figure illustrates drilling mud pressure. In the illustrated embodiment, the flow is varied between 200 gallons per minute and 400 gallons per minute.

Figure 5:
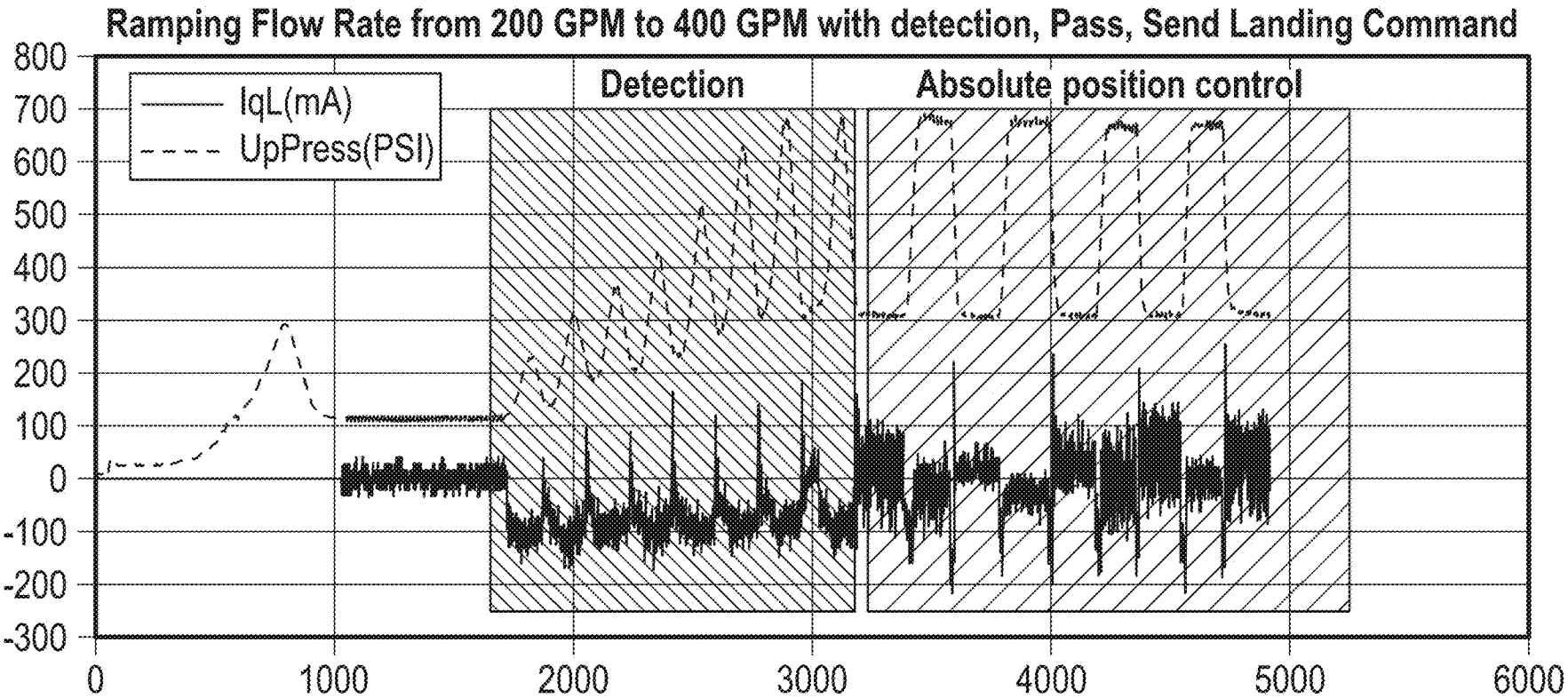
FIG. 5 is a plot of detection sequence performed under increasing flow rate.

FIG. 5 illustrates a plot of detection sequence performed under increasing flow rates. Similar to FIG. 4, the left most portions of the figure are conducted under the detection sequence, where the right most portions of the figure are conducted under absolute position control of the mud pulse equipment. The bottom most portion of the figure relates to measured current where the top-most portion of the figure illustrates drilling mud pressure. In the illustrated embodiment, the flow is increased from 200 gallons per minute to 400 gallons per minute.

As can be understood, if the rotor position is modulated, the differential standpipe pressure at the surface is also modulated. A pulse width modulation can also be advantageously used to create the modulation, with the motor closing and opening the modulator to create the highs and lows of measurable pressure at the surface.

The motor controller; however, does not know the angular position of the rotor in relation to the stator; and therefore, does not know the status of a specific position for the rotor. In such cases, it is impossible to ascertain if the positioning is related to being open, closed, or partially closed. The motor controller only knows its own position, measured by a component defined as a "resolver". Without a reference, the positioning is unknown.

The aspects disclosed herein overcome these drawbacks. In the aspects provided, operators may ascertain where a piece of untethered equipment is during pump down activities. For definitional purposes, pump down activities are defined as flowing mud to a downhole location and transporting equipment with these transient mud flows. In the embodiments described, operators will understand the location of equipment being transported downhole unlike conventional pump down operations. In embodiments, field personnel are able to ascertain if the equipment is lodged or stuck during pump down operations. Conventional technologies do not have such advantages or capabilities; therefore, the example embodiments disclosed have significant benefits compared to those technologies. Further benefits are also achieved by knowing the exact status and positioning of equipment, such as rotors, during the pump down activities.

In one embodiment of the disclosure, a method for communication with untethered systems is described. In this embodiment, a motor with motor controller and rotor are sent to a downhole location. This equipment may be connected to other equipment, such as a downhole package, which includes fluid pressure measurement devices. Prior to pump down operations, without energizing the motor coils, a rotor may be aligned or placed in a fully open position. After the alignment of the rotor to the fully open position, motor control for the motor controlling the rotor is initialized to record the rotor angle. The recording of the rotor angle may be performed and internally stored within a microprocessor as part of the downhole package or may be transmitted to the up-hole location at a timer after pump-down initiation.

In a second embodiment of the disclosure, an automated approach may be performed to ascertain positioning of the rotor during pump-down activities. In this method a fixed rotation speed may be established with the rotor to communicate to surface while pumping down the downhole system. To accomplish this, the rotor may be aligned, such as during the first method, to an overall open position prior to energizing motor coils. The motor may be set to a constant or "fixed" rotational speed. In this embodiment, since the rotor does have a known open position and the rotational speed is fixed, it may determine the position of the rotor through monitoring of the motor controller. Such monitoring may occur through the observation of the 3-phase currents provided to the motor. Other inputs such as the motor angle and Iq (torque current) for the motor may form a control loop. This method may be defined as a communication and calibration sequence. The calibration sequence consists of rotating the motor in the flow, recording the currents, power, torque, and relating it to the open and closed positions.

In some embodiments, the motor control torque is small and almost constant while the motor holds the modulator in place. This torque is used to move and rotate the modulator while the mud is being pumped down to the downhole environment. During rotor (modulator) continuous rotation, the torque current (Iq) is smallest when the rotor is in the most opened position. This correlation allows real time embedded software to detect the modulator in a fully open position. This data may be stored locally or transmitted to an up-hole location for use by the operators. The real time embedded software may be incorporated with the motor control system, in one non-limiting embodiment.

Figure 6:
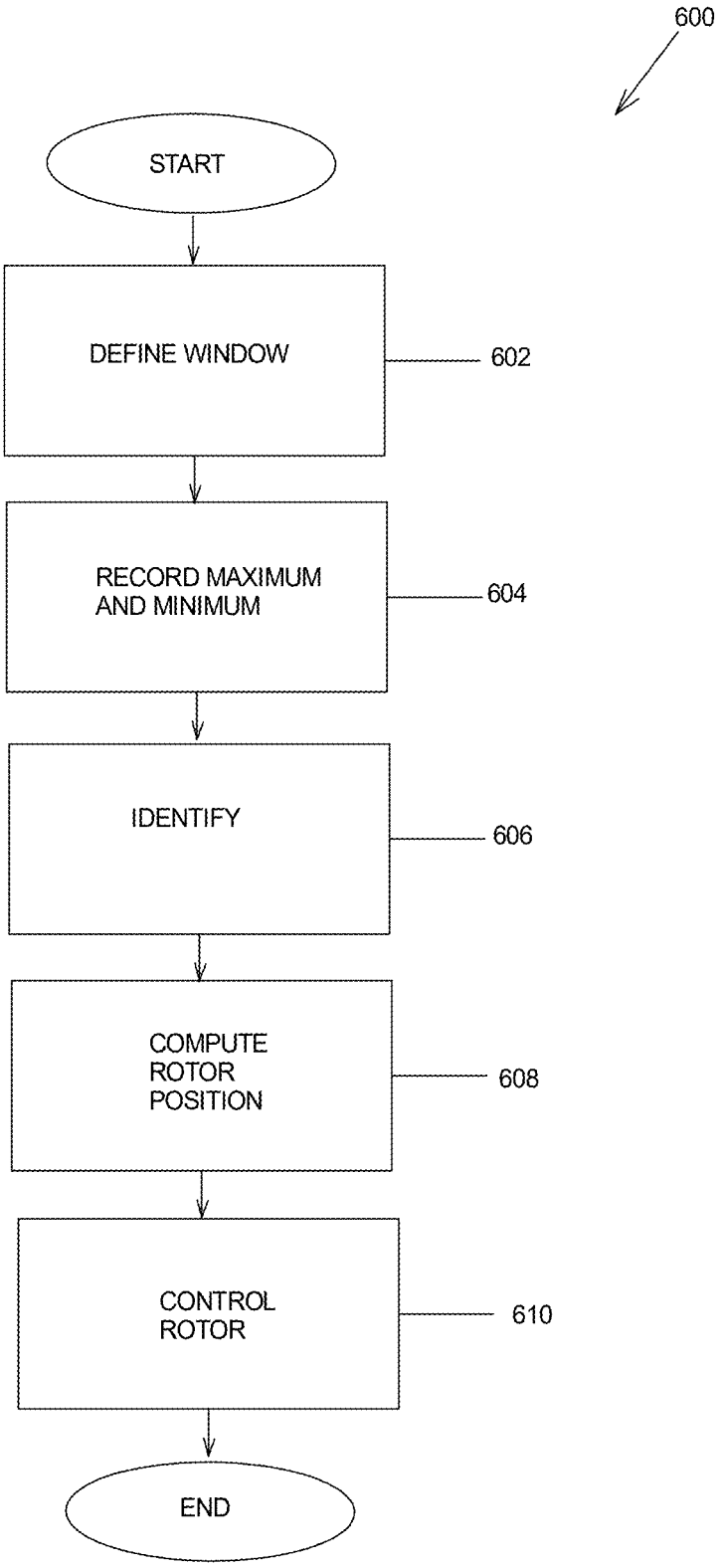
FIG. 6 is a first example method of communication for untethered downhole systems in one example embodiment of the disclosure.

The first method 600, as described in FIG. 6, provides for, at 602, defining a window for sampling a torque-related current and a modulator rotor relative position-related parameter. At 604, the method proceeds with using the defined window, recording local maximum and local minimum values of the torque-related current versus a modulator rotor relative position-related parameter of a rotor of a rotary pulser system in the untethered system. The method continues, at 606, with identifying at least one of consecutive torque-related current minimum values and consecutive torque-related current maximum values based on a periodicity. The method continues, at 608, with computing an absolute modulator rotor position based on the periodic maxima and minima of the torque-related current. The method continues, at 610, with controlling the modulator rotor using the absolute modulator rotor position to modulate uplink signals to a surface environment.

Figure 7:
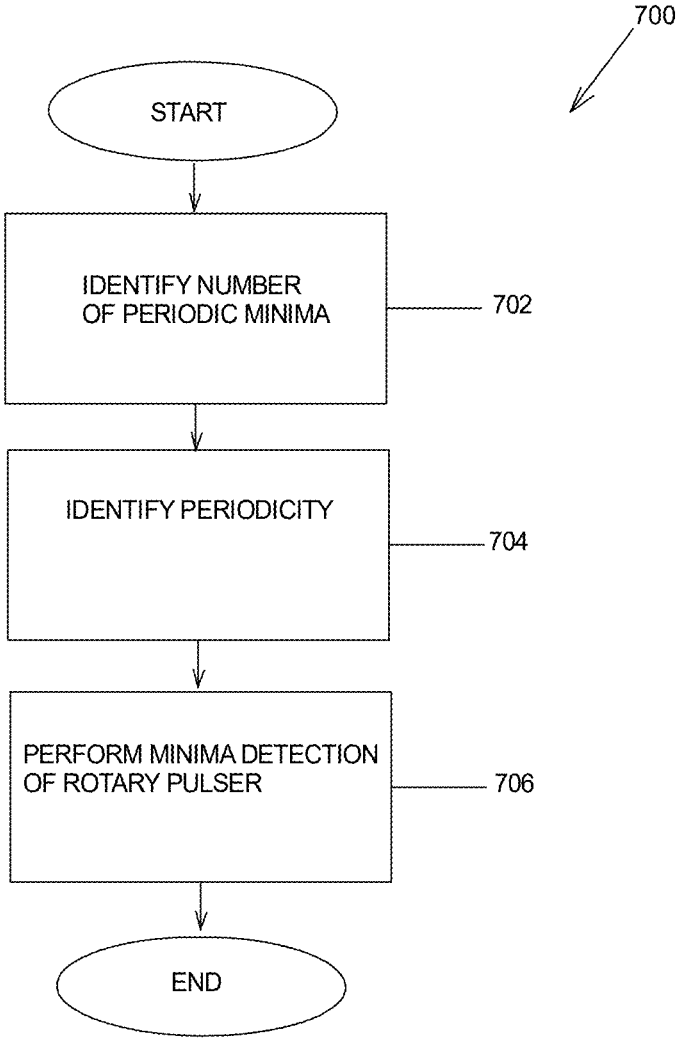
FIG. 7 is a second example method of communication for untethered downhole systems described in the disclosure.

The second method for evaluating data is illustrated in FIG. 7. The method 700 disclosed allows for analysis of the Iq torque curve to rotor opening position. The method 700 entails, at 702, identifying a number of periodic minima of a torque curve which comprises identifying timing between the periodic minima of the torque current Iq. At 704, the method continues with identifying a periodicity of the data. At 706, the method further provides for, using the periodicity of the data, performing minima detection over several periods of rotation of the rotary pulser.

In one such embodiment, the modulator may rotate for five (5) full open-close modulator periods at steady speed, while Iq and motor resolver position are acquired. During or after the acquisition process, embedded software can determine the motor position where the Iq current is minimum by looking at the minimum over four (4) full periods of the rotor. As will be understood, any number of full periods may be used to ensure accuracy. For example, it may be evaluated that ten (10) full periods provide a more accurate representation and better results.

Once performed, values obtained from the motor controller will identify when the Iq current is at a minimum value. For example, a motor position of 34.57 turns may correspond to a Iq current minimum value. Furthermore, knowing the motor speed, number of lobes and the gear box ratio can determine all other motor positions where the current will be minimized as well as the motor positions where the current will be maximized. In one example embodiment, for a 30:1 gear box ratio and 2 lobes modulator, evaluating the data corresponds to 2 modulator periods per 360 degrees turn; therefore, 1 modulator period per 15 turns of the motor.

In the embodiments disclosed above, the minimum current corresponds to the open position+an offset that can be determined in a lab environment with a surface flow loop system. In further embodiments, the closed position is determined using the shape of the rotor. An example is if the modulator has 2 lobes, the angular offset between the open and closed position is 90 degrees, or a quarter of a turn of the modulator.

Once the open and closed positions are determined, they can be used in a variety of ways. The positions may be used to help in up-link. In embodiments, a variable duty cycle or frequency may be used.

In other embodiments, the actual position of the modulator may be advantageously used to free jamming events that may occur through debris accumulations. For example, if the current needed to move the rotor is above a predetermined value, the rotor can be slowly commanded to spin to its fully open location so that debris are flushed out of the modulator. Debris may have accumulated in the modulator or system, causing the discrepancy.

In other embodiments, data obtained from the modulator may be used to determine speeds and drag of equipment being transported to the downhole location. Using this data, velocity of the transported equipment may be determined. In other embodiments, the amount of velocity may be altered, wherein closing of the modulator would increase the overall velocity of the equipment, and opening of the modulator would decrease the overall velocity of the equipment traveling downhole.

Example embodiments of the claims are described. The features described in these embodiments should not be construed to limit the description of the inventive features of the application. In one example embodiment, the method may comprise defining a window for sampling a torque-related current and a modulator rotor relative position-related parameter. The method may also comprise using the defined window, recording local maximum and local minimum values of the torque-related current versus a modulator rotor relative position-related parameter of a rotor of a rotary pulser system in the untethered system. The method may also comprise identifying at least one of consecutive torque-related current minimum values and consecutive torque-related current maximum values based on a periodicity. The method may also comprise computing an absolute modulator rotor position based on the periodic maxima and minima of the torque-related current. The method may also comprise controlling the modulator rotor using the absolute modulator rotor position to modulate uplink signals to a surface environment.

In another example embodiment, the method may be performed wherein the position-related parameter is derived from at least one of a time, a motor speed and a ratio of a gearbox linking a motor to the modulator rotor.

In another example embodiment, the method may be performed wherein the position-related parameter is derived from at least one of an output of a resolver and a ratio of a gearbox linking a motor to the modulator rotor.

In another example embodiment, the method may be performed wherein a resulting up-hole mud column pressure as modulated by modulator rotor is measured at an up-hole position by a single pressure sensor.

In another example embodiment, the method may further comprise optimizing a data rate communicated upwards by controlling the modulator rotor between a fully open and fully closed position.

In another example embodiment of the disclosure, a method of communication for a downhole system is described. The method may entail obtaining a downhole system that has a motor, a gearbox, a modulator rotor, and a relative position measurement system. The method may further comprise recording values of a torque-related current versus a position-related parameter during a cycling of the modulator rotor. The method may further comprise placing the downhole system in a tubular within a drilling system. The method may further comprise releasing the downhole system into the tubular. The method may further comprise transporting the downhole system along the tubular through pumping of drilling mud. The method may further comprise during the transporting of the downhole system, sending data from the downhole system as the modulator rotor spins. The method may further comprise receiving the data from the downhole system at an up-hole location. The method may further comprise analyzing the data to extract at least one of a status and message from the downhole system.

In another example embodiment, the method may be performed wherein the up-hole location is a standpipe equipped with a pressure sensor.

In another example embodiment, the method may be performed wherein a pulse width modulation is used during the sending of the data from the downhole system.

In another example embodiment, the method may be performed wherein the downhole system is configured as an untethered system.

In another example embodiment, the method may be performed wherein the sending of the data from the downhole system is modulated as a function of a position of the downhole system within the tubular in order to optimize a data rate.

In another example embodiment, the method may be performed wherein a position of the downhole system is measured by a collar casing locator.

In another example embodiment, the method may be performed wherein the modulator controls a pressure drop across the downhole measurement system.

In another example embodiment, the method may be performed wherein the pressure drop is caused by drag forces from the drilling mud.

In another example embodiment of the disclosure, a method of communication for a downhole system is disclosed. The method may comprise obtaining a downhole system that has a motor, a gearbox, a modulator rotor, and a relative position measurement system. The method may further comprise recording values of a torque-related current versus a position-related parameter during a cycling of the modulator rotor. The method may further comprise placing the downhole system in a tubular within a drilling system. The method may further comprise releasing the downhole system into the tubular. The method may further comprise transporting the downhole system along the tubular through pumping of drilling mud. The method may further comprise during the transporting of the downhole system, sending data from the downhole system as the modulator rotor spins. The method may further comprise receiving the data from the downhole system at an up-hole location. The method may further comprise analyzing the data to extract at least one of a status and message from the downhole system, wherein a modulator rotor is controlled during the transporting of the downhole system to enable an unjamming of the downhole system from a jamming event created by debris accumulation in the modulator.

In another example embodiment, the method may be performed wherein the debris accumulation occurs between a stator and the modulator rotor.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method of communication for untethered systems, comprising:

defining a window for sampling a torque-related current and a relative position-related parameter of a modulator rotor of a rotary pulser system in a first untethered system;

using the defined window, recording local maximum and local minimum values of the torque-related current versus the relative position-related parameter;

identifying at least one of consecutive torque-related current minimum values and consecutive torque-related current maximum values based on a periodicity;

computing an absolute modulator rotor position based on periodic maxima and minima of the torque-related current; and controlling the modulator rotor using the absolute modulator rotor position to modulate uplink signals to a surface environment.

2. The method according to claim 1, wherein the relative position-related parameter is derived from at least one of a time, a motor speed, and a ratio of a gearbox linking a motor to the modulator rotor.

3. The method according to claim 1, wherein the relative position-related parameter is derived from at least one of an output of a resolver and a ratio of a gearbox linking a motor to the modulator rotor.

4. The method according to claim 1, wherein a resulting up-hole mud column pressure as modulated by the modulator rotor is measured at an up-hole position by a single pressure sensor.

5. The method according to claim 1, further comprising optimizing a data rate communicated upwards by controlling the modulator rotor between a fully open position and a fully closed position.

* * * * *